US007472712B2

(12) United States Patent
Ashton et al.

(10) Patent No.: US 7,472,712 B2
(45) Date of Patent: Jan. 6, 2009

(54) DISHWASHER FILTER

(75) Inventors: Robert H. Ashton, Watervliet, MI (US); Joseph K. Sharkey, Niles, MI (US); Vincent P. Gurubatham, St. Joseph, MI (US); Aaron M. Torberg, Windham, ME (US)

(73) Assignee: Whirlpool Corporation, Benton Harbor, MI (US)

( * ) Notice: Subject to any disclaimer, the term of this patent is extended or adjusted under 35 U.S.C. 154(b) by 649 days.

(21) Appl. No.: 10/656,642

(22) Filed: Sep. 5, 2003

(65) Prior Publication Data

US 2005/0051201 A1 Mar. 10, 2005

(51) Int. Cl.
*A47L 15/42* (2006.01)

(52) U.S. Cl. ..... 134/104.1; 134/110; 134/111

(58) Field of Classification Search ..... 134/56 D, 134/57 D, 104.1

See application file for complete search history.

(56) References Cited

U.S. PATENT DOCUMENTS

| | | | | | |
|---|---|---|---|---|---|
| 3,122,148 | A * | 2/1964 | Alabaster | 134/56 D |
| 3,183,120 | A * | 5/1965 | Mori | 134/7 |
| 3,807,419 | A * | 4/1974 | Cushing et al. | 134/104.1 |
| 3,870,417 | A | 3/1975 | Bashark | 356/208 |
| 3,888,269 | A | 6/1975 | Bashark | 134/57 |
| 4,150,679 | A * | 4/1979 | Cushing et al. | 134/104.1 |
| 4,210,285 | A * | 7/1980 | Dicken et al. | 239/251 |
| 5,320,120 | A * | 6/1994 | Hoffman et al. | 134/104.1 |
| 5,743,281 | A * | 4/1998 | Sargeant et al. | 134/57 D |
| 5,909,743 | A * | 6/1999 | Thies et al. | 134/10 |
| 6,103,017 | A | 8/2000 | Thies et al. | 134/10 |
| 6,182,674 | B1 * | 2/2001 | Jozwiak et al. | 134/56 R |
| 6,509,558 | B1 | 1/2003 | Loch et al. | 250/222.2 |
| 2003/0213505 | A1 * | 11/2003 | Price et al. | 134/25.2 |
| 2004/0050774 | A1 * | 3/2004 | Jerg | 210/498 |

FOREIGN PATENT DOCUMENTS

| | | | |
|---|---|---|---|
| JP | 4200429 | * | 7/1992 |
| JP | 4200429 | A | 7/1992 |

* cited by examiner

*Primary Examiner*—Michael Barr
*Assistant Examiner*—Jason P Riggleman
(74) *Attorney, Agent, or Firm*—John Morrison; Michael D. Lafrenz

(57) ABSTRACT

An automatic dishwasher having a wash chamber is provided with a filter for filtering wash liquid circulated in the wash chamber. The filter includes a filter chamber outside the wash chamber. An inlet to and outlet from the filter chamber in a wall of the wash chamber allows wash liquid circulating in the wash chamber to enter the filter chamber and to flow out of the filter chamber through a filter element back into the wash chamber for filtering particulate material from wash liquid circulating in the wash chamber. A drain outlet at the bottom of the filter chamber allows wash liquid and material filtered by the filter to flow to the household drain. Sensors can be provided to detect a clogged or partially clogged filter and initiate a purge cycle to remove wash liquid and material filtered by the filter to the household drain.

31 Claims, 6 Drawing Sheets

DISHWASHER FILTER

BACKGROUND OF THE INVENTION

1. Field of the Invention

The invention relates to dishwashing machines, and in particular to a filter for a dishwashing machine positioned in a wall of the wash chamber to filter material from wash liquid circulating in the dishwasher.

2. Description of the Related Art

Dishwashers for use in the home typically have a filter arrangement to filter material from wash liquid circulating in the dishwasher to prevent such material from re-depositing on ware being washed in the dishwasher. Many dishwashers have a filter mechanism connected with and/or associated with the circulation pump for the dishwasher in a pump filter module. Domestic dishwashers are known that have a bypass filter arrangement independent of the circulation pump to filter wash liquid upstream of the circulation pump. Domestic dishwashers are also known that include a sensor(s) to determine the amount of food particles and other material in wash liquid circulating in a dishwasher or contained in a filter.

SUMMARY OF THE INVENTION

In accordance with the present invention, a filter for filtering wash liquid is provided in a wall of a wash chamber having a plurality of walls and a floor. The dishwasher includes a pump for circulating wash liquid in the wash chamber through a rotatable spray arm or arms. The filter includes a chamber wall defining a filter chamber with the exterior surface of one of the wash chamber walls. The filter includes an inlet in the wall communicating with the filter chamber and an outlet in the wall also communicating with the filter chamber. The inlet opening can be formed in part by a portion of the wall curving into the filter chamber to allow wash liquid flowing down the wall to flow into the filter chamber. A filter element is provided in the outlet for filtering wash liquid flowing out of the filter chamber into the wash chamber. The filter chamber includes a drain outlet in the bottom of the filter chamber for draining wash liquid and material filtered by the filter to drain.

In accordance with another aspect of the invention, the filter can include a front wall and a rear wall forming a filter chamber with the front wall having inlet and outlet openings for allowing wash liquid to flow into and out of the filter chamber. The inlet opening can be formed in part by a portion of the front wall curving into the filter chamber to allow wash liquid flowing down the wall to flow into the filter chamber. The filter can be mounted in an opening in the wall of the wash chamber. The filter chamber includes a drain outlet in the bottom of the filter chamber for draining wash liquid and material filtered by the filter to drain.

In accordance with another aspect of the invention, one or more sensors can be provided to sense when wash liquid and material filtered from the wash liquid rise to a predetermined level in the filter chamber. The sensor(s) can be connected to a control to purge wash liquid and filtered material from the filter chamber in response to the sensor(s) detecting a predetermined level of wash liquid and/or filtered material in the filter chamber.

DESCRIPTION OF THE INVENTION

Figure 3:
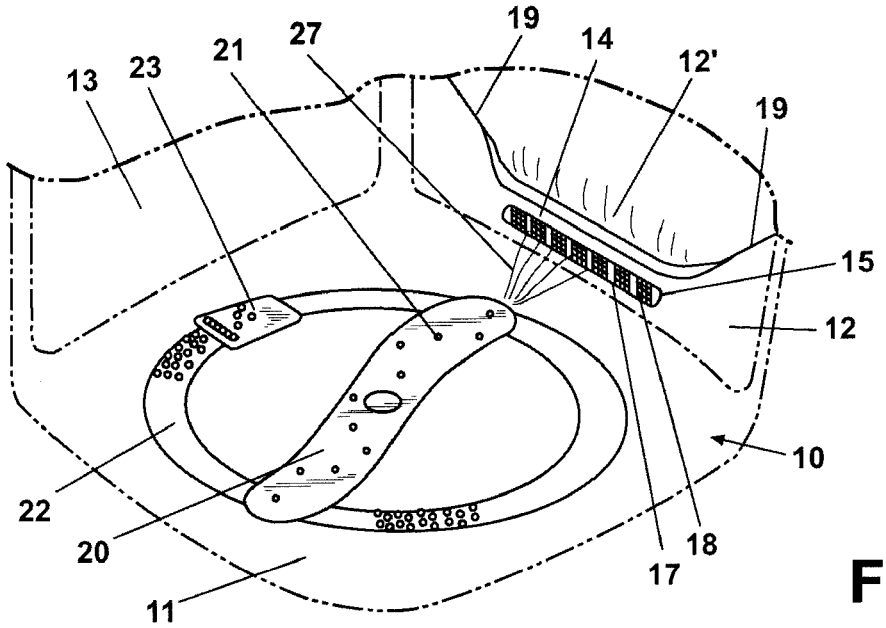
FIG. 3 is a partial schematic view of a wash chamber showing portions of a wash system and a filter according to the invention positioned in a wall of the wash chamber.

In accordance with the invention as shown in the drawings, and as shown in FIG. 3 in schematic form, a wash chamber 10 for a dishwasher can include a floor 11 and can include a plurality of walls 12 and 13. One of the walls 12 can include a filter, generally indicated at 15, according to the invention. Filter 15 can include an inlet opening 16 in wall 12 communicating with a filter chamber, not shown, that can be located on the outside of wall 12. Filter 15 can include an outlet opening 17 in wall 12 below inlet opening 16 and communicating with the filter chamber, not shown. A filter element 18 can filter washing liquid passing through outlet opening 17. A wall portion 12' of wall 12 above inlet opening 16 can curve into the filter chamber, not shown. A wall portion 14 of wall 12 below inlet opening 16 can lie in the plane of wall 12. Thus, inlet opening 16 can be defined by wall portion 12' curving into the filter chamber, not shown, and wall portion 14. Outlet opening 17 can be formed in wall portion 14. Wall 12 can also include one or more liquid gathering surfaces 19 arranged to direct wash liquid running down wall 12 into inlet opening 16. Liquid gathering surfaces 19 can extend to wall 13 and other walls of wash chamber 10.

A rotatable spray arm 20 can be provided spaced above the floor 11 for circulating wash liquid in the wash chamber 10. A circulating pump, not shown, can be provided for supplying wash liquid to the spray arm 20 under pressure to cause spray arm 20 to rotate and spray wash liquid in the wash chamber through a plurality of nozzles 21 as is well known in the art. Spray arm 20 can also have a nozzle, not shown, positioned at an end of spray arm 20 to spray liquid generally horizontally (shown at 27) to backwash filter element 18 as spray arm 20 rotates past filter 15. Backwashing filter element 18 can help prevent filter element 18 from clogging as food particles and the like are washed off dishes and filtered from the wash liquid by filter 15. While a single spray arm 20 is shown in this schematic view, those skilled in the art will understand that more than one spray arm can be provided to receive wash liquid under pressure from a circulating pump for circulation of wash liquid in the wash chamber. One or more conventional dishracks, not shown, can be provided in wash chamber 10 to hold dishes and utensils for washing as is well known in the art. A sump screen 22 can be provided in floor 11 for removing food particles from the wash liquid flowing to the circulating pump to avoid clogging the circulating pump or nozzles 21 in the spray arm 20. Sump screen 22 can have a removable strainer 23 arranged for gathering large food particles collected by the sump screen 22 as is well known in the art. Strainer 23 can be arranged for easy removal by the dishwasher user for manual cleaning from time to time as large food particles are collected. Those skilled in the art will recognize that sump screen 22 can be a part of a conventional dishwasher filter arrangement. When sump screen 22 is part of a conventional dishwasher filter arrangement, filter 15 can be arranged to be a fine filter to filter finer material the sump screen and conventional filter. Likewise those skilled in the art will recognize that filter 15 can be used alone without any other filter associated with the circulation pump. While sump screen 22 is shown in FIG. 3 as circular surrounding the center of spray arm 20, those skilled in the art will understand that a sump screen can be positioned in other locations on floor 11 to feed wash liquid to a circulation pump and a drain pump. A heater 24 (FIG. 14) can be provided adjacent sump screen 22 to heat wash liquid as is well known in the art.

In operation, wash liquid circulated in wash chamber 10 can impact and run down walls 12 and 13 to floor 11 returning to the circulation pump, not shown, through sump screen 22 as is well known in the art. Wash liquid running down wall 12 can follow curving wall portion 12' into the filter chamber and drop off the lower edge of wall portion 12' into the filter chamber due to surface tension of the wash liquid flowing along wall 12 and wall portion 12'. As the filter chamber, not shown, fills with wash liquid the wash liquid can rise to the level of outlet opening 17. Wash liquid in the filter chamber can flow out of the filter chamber, not shown, through outlet opening 17 and filter element 18 into the wash chamber 10. Food particles and other particulate material carried by wash liquid into the filter chamber remain in the filter chamber thus being filtered from the wash liquid by filter element 18.

Figure 1:
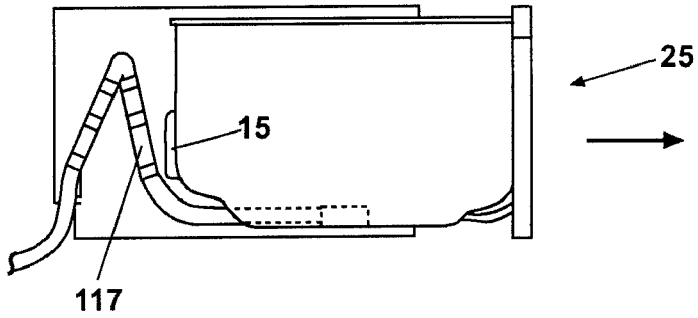
FIG. 1 is a partial schematic view of a modular dishwasher having a filter according to the invention positioned on a wall of a wash chamber that is a drawer mounted in a cabinet.

Wash chamber 10 can be a part of a modular dishwasher 25 in which the wash chamber 10 can be in the form of a drawer 26 as shown in FIG. 1. Wash chamber 10 can also be part of an undercounter or front loading portable dishwasher 28 in which the wash chamber 10 can be in the form of a front opening tub 29 as shown in FIG. 2.

Figure 4:
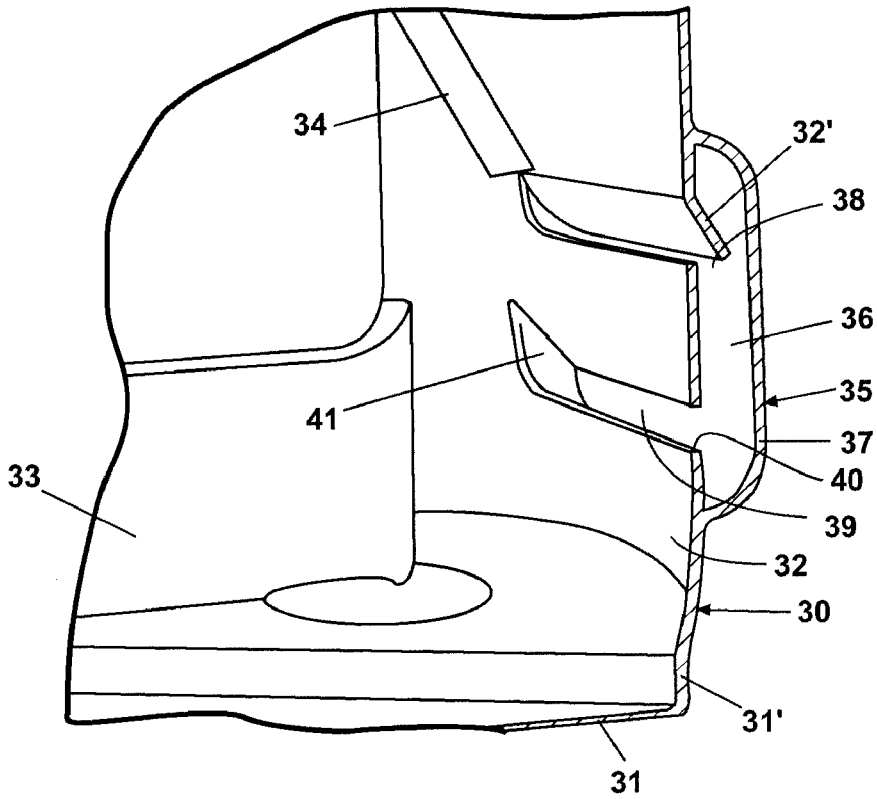
FIG. 4 is a partial perspective view of the inside of a dishwasher chamber showing one embodiment of a filter according to the invention.

Another embodiment of a filter according to the invention can be seen by referring to FIG. 4. Wash chamber 30 can include a floor 31 and walls 32 and 33. Wash chamber 30 can be formed of molded or formed plastic or can be formed of sheet material such as stainless steel. Wall 32 can include a filter generally indicated at 35. Filter 35 can include a filter chamber 36 formed by a chamber wall 37 and the outside surface of wall 32. Wash liquid can flow into filter chamber 36 from wash chamber 30 through inlet opening 38. Wash liquid can flow out of wash chamber 36 through outlet opening 39 and filter element 40 into wash chamber 30. Wall 32 can have a wall portion 32' above inlet opening 32 curving into filter chamber 36 to facilitate flow of wash liquid flowing down wall 32 into filter chamber 36. Wall portion 41 of wall 32 below inlet opening 38 can lie in the plane of wall 32. Inlet opening 38 can be defined by curving wall portion 32' and wall portion 41. Outlet opening 39 can be formed in wall portion 41. Wash liquid flowing down wall 32 can follow curved wall portion 32' into filter chamber 36 and drop off the bottom edge of wall portion 32' into the filter chamber 36 due to surface tension of the wash liquid on wall surface 32' as described above. Wall 32 can have a liquid gathering surface 34 formed into wall 32 on one or both sides of filter 35 to gather wash liquid flowing down wall 32 beyond the lateral extend of inlet opening 38 to direct additional wash liquid into the filter chamber. In the embodiment of FIG. 4 liquid gathering surface 34 can comprise a ledge formed in wall 32 sloping downwardly to inlet opening 38. A filter element 40 can be provided to filter particulate material from the wash liquid as wash liquid flows out of the filter chamber 36 into wash chamber 30. Filter element 40 can be attached to the inside surface of outlet opening 39, the outside surface of opening 39, or fastened in opening 39. Filter 40 can be provided with, or mounted in a frame and mechanically attached at opening 39 by well known fastening methods that can include mechanical fasteners, snap in fasteners, adhesives and sonic or plastic welding as are all well known in the art. Filter 40 can be co-molded in opening 39 or can be heat sealed, sonic welded or plastic welded in place in or over opening 39. Filter 40, as well as the filter elements in the other embodiments of the invention, can be formed of durable, woven or non-woven mesh material, porous sheet material, filter media, photo etched sheet material or other filter materials as are well known in the art. The openings in filter 40 can range in size from 0.1 mm to 2 mm, although those skilled in the art will readily understand that openings in the filter material can be larger or smaller depending on the degree of filtration desired. Filters 40 having openings of 0.2 mm to 0.3 mm can provide satisfactory filtration of wash liquid. Filter chamber 36 can have a drain outlet, not shown, at the bottom of filter chamber 36 to connect filter chamber 36 to a drain pump for draining wash liquid and material filtered by filter element 40 to the household drain, not shown.

Figure 2:
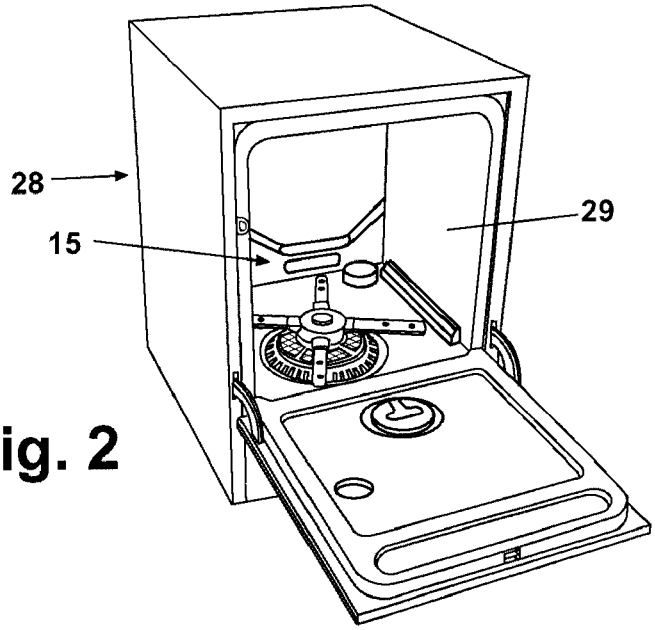
FIG. 2 is a schematic view of a dishwasher having a filter according to the invention positioned on a wall of a wash chamber that is a tub with a front opening typically found in front loading portable and undercounter dishwashers.

Wash chamber 30 can be a drawer for a modular dishwasher as shown in FIG. 1 or a tub for an undercounter or front loading portable dishwasher as shown in FIG. 2. Wash chamber 30 can be formed with wall portions 32' and 41 defining inlet opening 38 and outlet opening 39. Chamber wall 37 can be separately formed and attached to wash chamber 30 by methods well known in the art that can include sonic welding, adhesives, snap in arrangements and mechanical fasteners. Floor 31 can be arranged to define a sump 31' to support a circulation pump, not shown, and a sump screen, not shown, similar to sump screen 22 in FIG. 3 as will be readily understood by those skilled in the art. Wash chamber 30 can include one or more spray arms to circulate wash liquid as shown in FIG. 1 and can include one or more dishracks, not shown, to hold dishes and utensils to be washed as is well known in the art.

Figure 5:
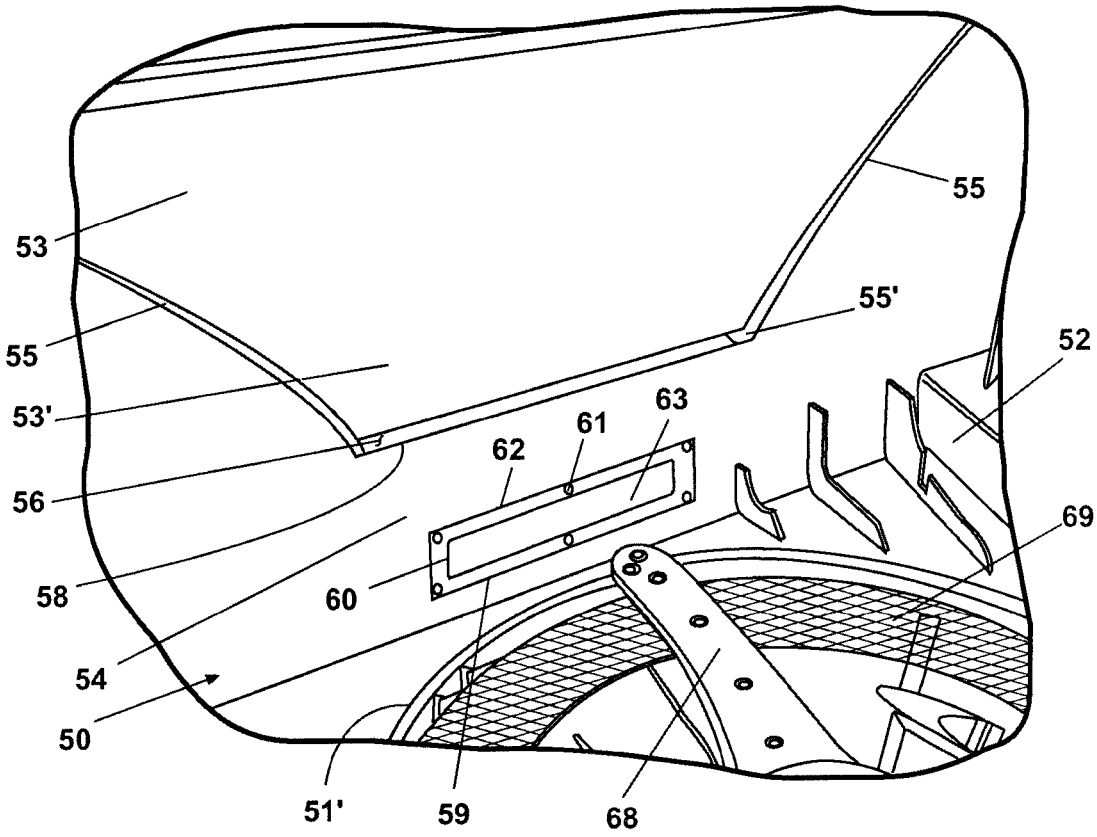
FIG. 5 is a partial perspective view of the inside of a dishwasher chamber showing another embodiment of a filter according to the invention.
Figure 6:
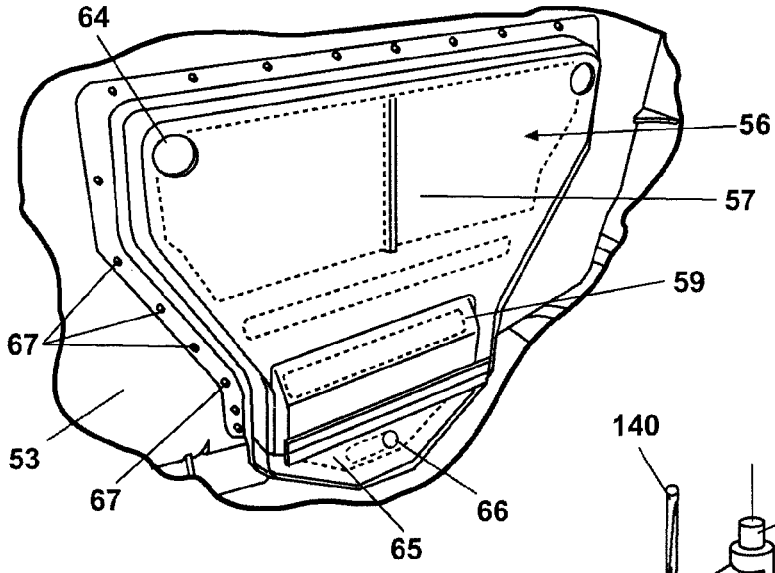
FIG. 6 is a partial perspective view of the outside of the dishwasher chamber of FIG. 5.

Another embodiment of a filter according to the invention can be seen by referring to FIG. 5 and FIG. 6. Wash chamber 50 for a dishwasher can include a floor 51 and walls 52 and 53. Wall 53 can include a wall portion 53' curving inwardly into filter chamber 56 above wall portion 54. Wall 53 can be the front wall, rear wall or one of the side walls of wash chamber 50 used in a modular dishwasher as shown in FIG. 1 as will be readily understood by those skilled in the art. If wash chamber 50 is part of a front opening dishwasher such as shown in FIG. 2, wall 53 can be part of the door, or one of the walls of the tub 29. Curving wall portion 53' and wall portion 54 can define an inlet opening 58 leading from wash chamber 50 into filter chamber 56. Wall portion 54 can lie in the plane of wall 53. Wall portion 54 can include an outlet opening 59 leading from filter chamber 56 into wash chamber 50. A filter element 60 can cover outlet opening 59 and can include a filter frame 62 holding filter material 63 in place covering outlet opening 59. Filter frame 62 can be held in place by fasteners 61. Wash liquid flowing down wall 53 can follow curved wall portion 53' into filter chamber 56 due to surface tension of wash liquid on wall portion 53' as described above. Those skilled in the art will recognize that well known methods may be used to permanently or removably retain the filter frame and filter material in place relative to outlet opening 59 that can include sonic welding, plastic welding, snap in fastening arrangements and mechanical fasteners. Those skilled in the art will understand that filter 60 can be permanently installed, or can be removable and replaceable should filter element become damaged. Wall 53 can include one or more liquid gathering surfaces or ledges 55 directed downwardly and inwardly to direct wash liquid flowing along wall 53 into inlet opening 58. Liquid gathering surfaces 55 can be formed integrally in wall 53, or can be attached subsequent to formation of wash chamber 50 as is well known in the art. The lower end 55' of liquid gathering surfaces 55 can close the gap between curving wall portion 53' curving into filter chamber 56 and wall 53 to direct wash liquid flowing along liquid gathering surfaces 55 into filter chamber 56. A sump 51' can be formed in wall 51 to locate a circulation pump, not shown, and a sump screen 69 for preventing food particles and the like from flowing into the circulation pump and spray arm 68 rotatably mounted in the floor 51. Wash liquid flowing in wash chamber 50 can flow down the walls 52 and 53 and across sump screen 69 to the circulation pump inlet, not shown. Wash liquid being circulated in wash chamber 50 by spray arm 68 can also fall directly on floor 51 and likewise flow across sump screen 69 to the circulation pump inlet, not shown.

Turning to FIG. 6, a chamber wall 57 is shown attached to the rear side of wall 53 defining with the rear side of wall 53 the filter chamber 56. Chamber wall 57 can be attached to the rear of wall 53 with suitable fasteners 67 or can be attached to the rear of wall 53 with other known means including sonic welding and plastic welding, adhesives or a snap in fastening arrangement. The lower end of chamber wall 57 can define a filter chamber sump 65 extending below outlet opening 59. Filter chamber sump 65 can provide space for a volume of wash liquid in filter chamber 56 to allow material filtered by filter element 60 to collect below filter element 60. A drain outlet 66 can be provided at the bottom of filter sump 65 to connect a drain line, not shown, leading to a drain pump, not shown, to provide a means to remove wash liquid and collected filtered material to a household drain, not shown. Chamber wall 57 can be provided with one or more air gaps 64 to allow ambient air to flow into and out of filter chamber 56 to vent the filter chamber to allow wash liquid to flow into and out of filter chamber 56 without concern about an air lock of the filter chamber. In addition, one or more air gaps can facilitate drying performance of the dishwasher by permitting dry ambient air to enter wash chamber 50 to establish a cross flow air flow during the drying portion of the dishwasher cycle. One or more air gaps can be provided in the embodiments the filters according to the invention shown in FIG. 4, FIG. 7, FIG. 8 and FIG. 18.

The sump screen 69 in the embodiment of FIG. 6 can have a removably mounted strainer, not shown, similar to the strainer 23 in FIG. 3 to facilitate removal of food particles filtered from the wash liquid by sump screen 69. Wash chamber 50 can have one or more spray arms, not shown, in addition of spray arm 68 and can have one or more dishracks, not shown, for holding dishes and utensils being washes as is well known to those skilled in the art.

Figure 7:
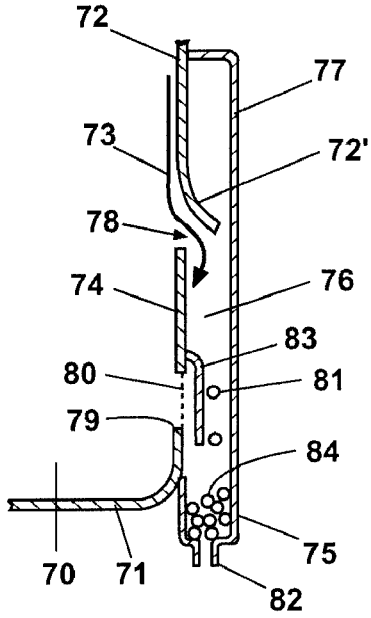
FIG. 7 is a partial schematic section view of another embodiment of a filter according to the invention.

Another embodiment of a filter according to the invention can be seen by referring to FIG. 7. A wash chamber 70 of a dishwasher can have a floor 71 and a wall 72. While only one wall is shown in the partial sectional view of FIG. 7, those skilled in the art will recognize that the wash chamber 70 can have a plurality of walls. Likewise those skilled in the art will recognize that wall 72 can be a rear wall, a front wall, or one of the side walls of wash chamber 70. Wall 72 can have a portion 72' curving into filter chamber 76 formed by the outside surface of wall 72 and chamber wall 77. Wash liquid flowing down wall 72 and wall portion 72' can follow wall portion 72' into filter chamber 76 due to surface tension of the wash liquid on wall portion 72' as described above. Wall portion 74 below inlet opening 78 can lie in the plane of wall 72. Wall portion 74 and curving wall portion 72' can define inlet opening 78 from wash chamber 70 into filter chamber 76. Wall portion 74 can have an outlet opening 79 from filter chamber 76 into wash chamber 70. A filter element 80 can be provided at outlet opening 79 to filter food particles 81 from wash liquid flowing from filter chamber 76 into wash chamber 70. A baffle 83 can be provided in filter chamber 76 spaced from and overlying outlet opening 79 and filter element 80 to direct food particles 81 to filter chamber sump 75 to reduce the clogging of filter element 80. Baffle 83 can be attached to wall portion 74 by sonic welding, plastic welding, adhesives, or can be molded with wall portion 74. Alternately, baffle 83 could be attached by other well known fastening arrangements as will be readily understood by one skilled in the art. A baffle like baffle 83 in FIG. 7 can be provided in the embodiments of the filter shown in FIG. 4, FIG. 5, FIG. 8 and FIG. 18 as will be appreciated by those skilled in the art. Wash chamber 70 can be used in a modular dishwasher as shown in FIG. 1 or a front opening dishwasher as shown in FIG. 2. Wash chamber 70 can have a circulation pump, drain pump, one or more spray arms, a sump screen and one or more dishracks, all not shown, as will be readily understood by those skilled in the art.

Figure 8:
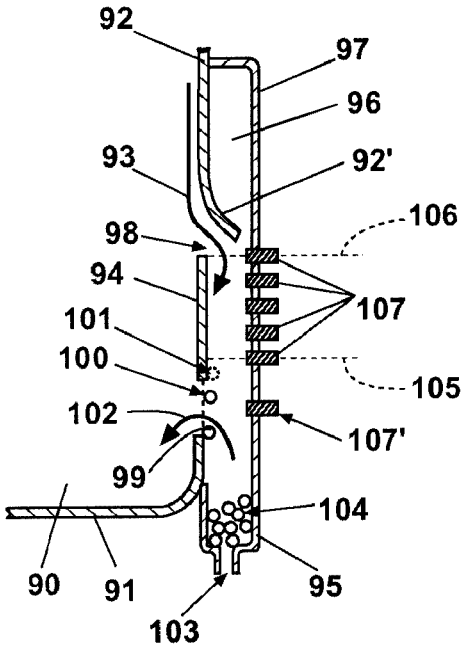
FIG. 8 is a partial schematic section view of another embodiment of a filter according to the invention having a plurality of sensors for determining the liquid level in the filter housing.
Figure 14:
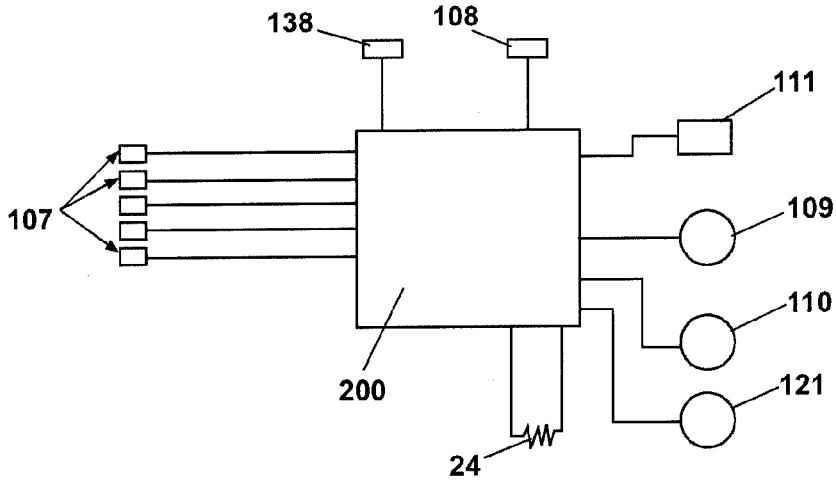
FIG. 14 is a block diagram of a control that can be used with a dishwasher having a filter according to the invention.
Figure 18:
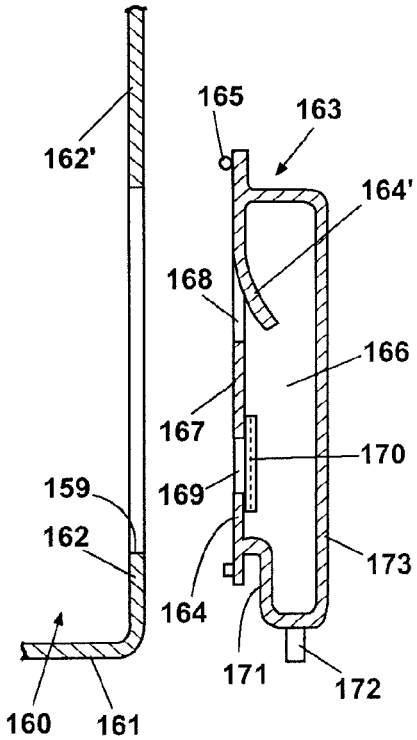
FIG. 18 is a partial exploded section view of another embodiment of a filter according to the invention.

Another embodiment of a filter according to the invention can be seen by referring to FIG. 8. A wash chamber 90 can be provided for a dishwasher having a floor 91 and a wall 92. Wall 92 can be the front wall, rear wall or one of the side walls of wash chamber 90. Wash chamber 90 can be used in a modular dishwasher as shown in FIG. 1 or a front opening dishwasher as shown in FIG. 2. Wall portion 92' of wall 92 can curve into filter chamber 96. Wall portion 94 below inlet opening 98 can lie in the plane of wall 92. Curving wall portion 92' and wall portion 94 can define inlet opening 98 leading from wash chamber 90 into filter chamber 96. Wash liquid 93 flowing down wall 92 and 92' can flow into filter chamber 96 and drop off the bottom end of curving wall portion 92' due to surface tension of the wash liquid on wall portion 92' as described above. Chamber wall 97 can define filter chamber 96 with the outer surface of wall 92. Chamber wall 97 can be attached to wall 92 with fasteners, not shown, or by sonic welding, plastic welding, adhesives or snap-in mounting arrangements as are well know to those skilled in the art. A filter chamber sump 95 can be provided at the bottom end of filter chamber 96 that can provide a space for accumulation of food particles 104. A filter element 100 can be positioned in outlet opening 99 in wall portion 94 to filter food particles and the like from wash liquid 102 flowing out of filter chamber 96 through filter element 100. Filter chamber sump 95 can allow at least a portion of the food particles 104 carried by wash liquid 93 into filter chamber 96 to settle and not clog filter element 100. A drain outlet 103 can be provided at the bottom of filter chamber sump 95 to allow wash liquid and accumulated food particles to be pumped to the household drain, not shown, by a drain pump, not shown. A liquid spray member 101 can be provided in filter chamber 96 for spraying fresh wash liquid over filter element 100 whenever wash liquid is added to wash chamber 90 by a wash liquid inlet valve 108 (FIG. 14). Spraying fresh wash liquid over filter element 100 can help remove accumulated food particles from filter element 100 to improve wash liquid flow through the filter element. A liquid spray member similar to liquid spray member 101 can be provided in the filters according to the invention as shown in FIG. 4, FIG. 5 and FIG. 18.

One or more sensors 107, 107' can be provided for filter chamber 96 to sense one or more wash liquid levels in filter chamber between a lower liquid level 105 and an upper liquid level 106. While sensors 107, 107' are shown mounted on chamber wall 97, those skilled in the art will recognize that sensors 107, 107' can be mounted on other portions of filter chamber 96, or even outside filter chamber 96, to sense wash liquid levels between lower liquid level 105 and upper liquid level 106. Those skilled in the art will recognize that one or more sensors 107' can be located below lower liquid level 105 such as opposite filter element 100. Sensors 107, 107' can be optical sensors, turbidity sensors or pressure sensors as are well known in the dishwasher art. U.S. Pat. Nos. 3,870,417, 3,888,269, and 6,509,558, each incorporated herein by reference, disclose use of optical sensors and turbidity sensors in dishwashers. U.S. Pat. Nos. 5,909,743 and 6,103,017, each incorporated herein by reference, disclose the use of pressure sensors to automatically initiate a filter purge cycle in dishwashers. If sensors 107, 107' are optical or turbidity sensors, one or more of the sensors can be used to detect the murkiness of the wash liquid in addition to sensing a clogged filter. Optical or turbidity sensors can be provided with a suitable control to initiate a purge cycle to remove murky wash liquid and add fresh wash liquid as will be understood by those skilled in the art. If sensor 107' is a pressure sensor, the pressure sensor can be used to detect rotation of the dishwasher spray arm when the dishwasher is operating in addition to detecting a clogged filter as described above. When the spray arm is rotating freely, the pressure sensed by a sensor 107' can vary as the spray arm, not shown, rotates, particularly if the spray arm includes one or more nozzles directed to provide a backwash spray for filter 100 as described above in paragraph [0022]. When the end of the spray arm rotates past filter chamber 96 the pressure sensed by sensor 107' can momentarily rise as the spray arm passes by filter 100 due to backwash spray flow through filter element 100 into chamber 96. If no increases in pressure are sensed, the dishwasher controller, not shown, can infer a "stuck spray arm" condition and activate a signal to advise the operator to check the spray arm.

The one or more sensors 107, 107' and a wash liquid inlet valve 108 can be connected to a controller 200 shown schematically in FIG. 14. In operation, controller 200 can cause liquid inlet valve 108 to fill wash chamber 90 with sufficient wash liquid. Controller 200 can cause a circulation pump 110 to operate causing wash liquid to be sprayed in wash chamber 90 by one or more spray arms, not shown, over dishes and utensils carried on one or more dishracks, not shown, as will be readily understood by those skilled in the art. A detergent and/or rinse additive dispenser 111 can be connected to controller 200 to provide for addition of detergent and/or rinse additive to dishwashing cycles as is well known in the art. As wash liquid runs down wall 92, the wash liquid 93 carrying food particles 104 and the like removed from dishes being washed in the wash chamber can follow curving wall portion 92' into filter chamber 96 due to surface tension of the wash liquid on wall surface 92' as described above. As wash liquid 93 accumulates in filter chamber 96 the level of the wash liquid rises to outlet opening 99. As wash liquid 93 rises to outlet opening 99, wash liquid 102 begins flowing through filter element 100 into wash chamber 90 to return to the circulation pump 110. Food particles and the like carried in wash liquid 93 can be retained in filter chamber 96 by filter element 100. Food particles 104 that are heavier than the wash liquid can accumulate in filter chamber sump 95. Some food particles 104 can be caught against filter element 100 by the flow of wash liquid through filter element 100 into wash chamber 90. As food particles accumulate on filter element 100, the level of wash liquid in filter chamber can rise to the top of filter element 100 represented by line 105. As food particles continue to accumulate in filter chamber 96 and on filter element 100 the wash liquid level in filter chamber 96 can rise to the inlet opening 98 represented by line 106 as flow of wash liquid through filter element 100 slows due to reduced filter element surface exposure due to accumulation of food particles 104. When the liquid level in filter chamber 96 rises to level 106 the flow of additional wash liquid into filter chamber 96 will stop since the filter chamber is full, and wash liquid will run down wall portion 94 bypassing filter chamber 96 and filter element 100 until the wash liquid level in filter chamber 96 drops.

The one or more sensors 107, 107' can be connected to controller 200 to cause controller 200 to initiate a filter purge cycle to operate drain pump 109 to drain wash liquid and food particles 104 from filter chamber sump 95 and lower the wash liquid level in filter chamber before the filter is completely clogged. A purge cycle can be initiated when the one or more sensors detect that the wash liquid in filter chamber 96 has risen to a predetermined level between levels 105 and 106. As described above in paragraph [0032], when one or more of sensors 107, 107' are optical or turbidity sensors, a purge cycle can be initiated when one or more of the sensors 107, 107' detects murky wash liquid. Concurrently with, or subsequent to operation of drain pump 109 in a purge cycle, controller 200 can operate inlet valve 108 to admit fresh wash liquid into wash chamber 90 to replace wash liquid and food particle removed by operation of drain pump 109. Fresh wash liquid can be supplied to wash chamber 90 through liquid spray member 101. Liquid spray member 101 can be arranged to spray fresh wash liquid over the surface of filter element in filter chamber 96 to flush accumulated food particles off the filter element 100 and into filter chamber sump 95. Liquid spray member 101 can be used alone to flush filter element 100, or can be used in combination with a spray arm, not shown, having one or more nozzles arranged to provide a backwash spray against filter 100 as described above. Thus, the purging of filter chamber 96 can remove accumulated food particles from filter chamber sump 95 and can flush accumulated food particles off the filter element 100 as well as flush murky wash liquid to drain. Following the purge cycle, controller 200 can de-energize drain pump 109 and inlet valve 108 and resume operation of circulation pump 110. Alternately, circulation pump 110 can continue to operate during the filter purge cycle. Controller 200 can be programmed to initiate one or more purge cycles in response to signals from the one or more sensors 107, 107'. Controller 200 can be arranged to modify the dishwasher program depending on how quickly sensors 107, 107' trigger a purge cycle and/or how many times a purge cycle occurs in a dishwasher cycle or as disclosed in U.S. Pat. Nos. 5,909,743 and 6,103,017. Those skilled in the art will appreciated that one or more sensors 107, 107' and/or a liquid spray member 101 can be provided in the embodiments of the filter shown in FIG. 4, FIG. 5, FIG. 7 and FIG. 18 if desired to provide the capability of a purge cycle.

Figure 9:
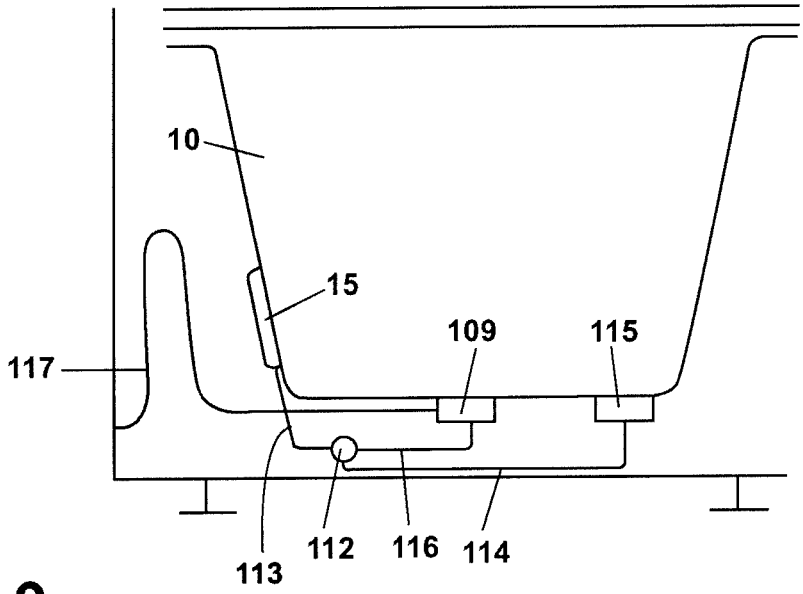
FIG. 9 is a partial schematic view of a dishwasher wash chamber showing connection of a filter according to the invention to a drain pump through a selector valve.

A filter according to the invention can be connected to the household drain in a number of ways. Turning to FIG. 9 through FIG. 13 schematic drawings of a number of embodiments of drain connection arrangements can be seen. In the embodiment of FIG. 9 the filter chamber drain of filter 15 can be connected by line 113 to one inlet of selector valve 112. Wash chamber drain outlet 115 can be connected by line 114 to a second inlet of selector valve 112. Line 116 can connect the outlet of selector valve 112 to drain pump 109. Drain line 117 can connect to a household drain, not shown, as is well known in the art. In operation, when draining of filter 15 is desired, selector valve 112 can be operated to connect line 113 to line 116 and drain pump can be operated to draw wash liquid and food particles from filter 15 and pump the wash liquid and food particles to household drain as is well known in the art. When draining of wash chamber 10 is desired, selector valve 112 can be operated to connect line 114 to line 116 so that operation of drain pump 109 can draw wash liquid from wash chamber 10 through wash chamber drain 115 and pump the wash liquid to the household drain. Those skilled in the art will understand that the operations described in this paragraph can be under the control of a controller, not shown, controlling operation of the dishwasher.

Figure 10:
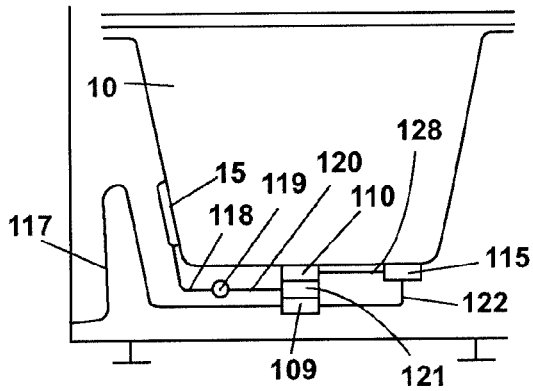
FIG. 10 is a partial schematic view of a dishwasher wash chamber showing another embodiment of connection of a filter according to the invention to a drain pump.

Turning to FIG. 10, the filter drain outlet of filter 15 according to the invention can be connected by line 118 to valve 119 to line 120 to filter drain pump 121 to pump wash liquid and food particles from the filter chamber to household drain, not shown, via line 117. Wash chamber drain 115 can be connected by line 122 to drain pump 109 to pump wash liquid from the wash chamber 10 to the household, not shown, drain via line 117. In the embodiment of FIG. 10, circulation pump 110, filter drain pump 121 and drain pump 109 can be driven by a single pump drive motor, not shown. In operation, when pump drive motor rotates in a first direction circulation pump 110 can pump wash liquid for recirculation in wash chamber 10 as is well known in the art. When valve 119 is open and pump drive motor is rotating in the first direction, filter drain pump 121 can pump wash liquid and food particles from filter 15. When the pump drive motor rotates in the opposite direction drain pump 109 can pump wash liquid from wash chamber drain 115 to the household drain, not shown, via line 117. Pumps 110 and 121 can be arranged to not pump wash liquid when the drive motor rotates in the opposite direction as is well known in the art. Line 125 can connect circulation pump 110 to the wash chamber drain for supplying wash liquid to the circulation pump. Valve 119, filter drain pump 121, drain pump 109 and circulation pump 110 can be controlled by a suitable controller, not shown, controlling operation of the dishwasher as is well known in the art.

Figure 11:
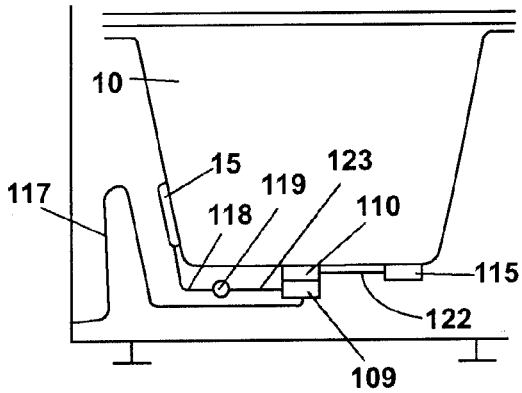
FIG. 11 is a partial schematic view of a dishwasher wash chamber showing another embodiment of connection of a filter according to the invention to a drain pump.

Turning to FIG. 11, the filter chamber outlet of a filter 15 according to the invention can be connected by line 118 to valve 119 to line 123 to drain pump 109. Drain pump 109 can be driven by a reversible pump drive motor, not shown. Wash chamber drain 115 can be connected to drain pump 109 by line 122. Circulation pump 110 can be driven by a reversible pump drive motor, not shown that drives drain pump 109. In operation, when the pump drive motor rotates in a first direction, circulation pump 110 can operate to recirculate wash liquid in wash chamber 10 and drain pump 109 can operate to draw wash liquid and food particles from filter 15 under control of valve 119 and pump the wash liquid and food particles to household drain, not shown, via drain line 117 when valve 119 is open. When the pump drive motor, not shown, operates in the reverse direction drain pump 109 can operate to draw wash liquid from wash chamber drain 115 and pump the wash liquid to the household drain via drain line 117. When pump drive motor operates in the reverse direction circulation pump 110 can be arranged to not recirculate wash liquid in wash chamber 10 as is well known to those skilled in the art. Valve 119, drain pump 109 and circulation pump 110 can be controlled by a suitable controller, not shown, controlling operation of the dishwasher as is well known in the art.

Figure 12:
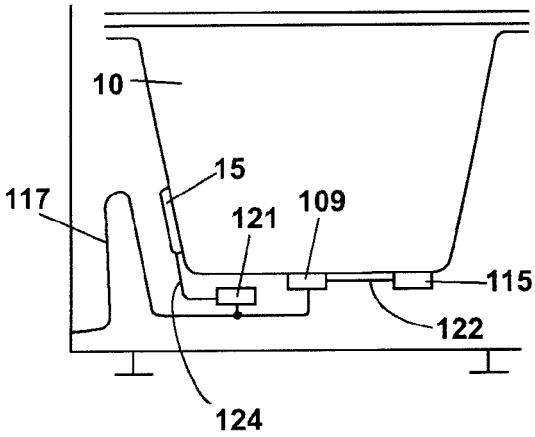
FIG. 12 is a partial schematic view of a dishwasher wash chamber showing another embodiment of connection of a filter according to the invention to a drain pump.

Turning to FIG. 12, the filter chamber outlet of a filter 15 according to the invention can be connected to filter drain pump 121 by line 124. Wash chamber drain 115 can be connected to drain pump 109 by line 122. Drain pump 121 can be operated by one motor and drain pump 109 can be operated by another motor, both not shown. Those skilled in the art will recognize that a circulation pump, not shown, can be provided to recirculate wash liquid in wash chamber 10. The outlets of drain pump 109 and filter drain pump 121 can be connected to line 117 to direct wash liquid from the respective drain pumps to the household drain, not shown. Check valves, not shown, can be provided in the lines from drain pump 109 and filter drain pump 121 to drain line 117 to prevent wash liquid and food particles being pumped by the respective pumps from being pumped into the other pump. In operation when drain pump 121 is operated wash liquid and food particles from filter 15 can be pumped to household drain. Likewise, when drain pump 109 is operated wash liquid can be pumped from wash chamber drain 115 to household drain. Those skill in the art will recognize that pump 109 can be driven by a reversible motor that can also be connected to drive a circulation pump, not shown, so that drain pump 109 can operate when the reversible motor is rotated in a first direction and circulation pump, not shown can operate when the reversible motor is rotated in a second direction. A suitable controller, not shown, controlling operation of the dishwasher can control filter drain pump 121 and drain pump 109.

Figure 13:
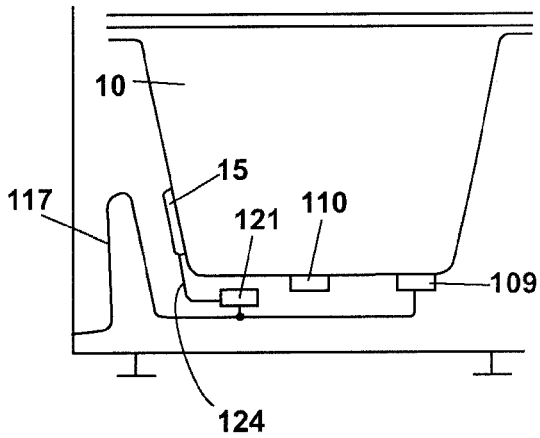
FIG. 13 is a partial schematic view of a dishwasher wash chamber showing another embodiment of connection of a filter according to the invention to a drain pump.

Turning to FIG. 13, the filter chamber outlet of a filter 15 according to the invention can be connected to a filter drain pump 121 by line 124 as in FIG. 12. A circulation pump 110 and drain pump 109 can be provided to recirculate and drain wash liquid respectively. In the embodiment of FIG. 13 all three pumps can be operated by separate motors, not shown. Drain pump 109 and filter drain pump 121 can be connected to line 117 for conducting wash liquid pumped by the respective pumps to household drain. Those skilled in the art will recognize that check valves, not shown, can be provided in the lines from pump 109 and pump 121 to drain line 117 to prevent wash liquid and food particles being pumped by the respective pumps from being pumped into the other pump. In operation, motors for the respective pumps can be operated by a suitable controller, not shown, to recirculate wash liquid in wash chamber 10, drain wash liquid and food particles from filter 15 and to drain wash liquid from wash chamber drain 115 as will be readily understood by one skilled in the art.

Figure 16:
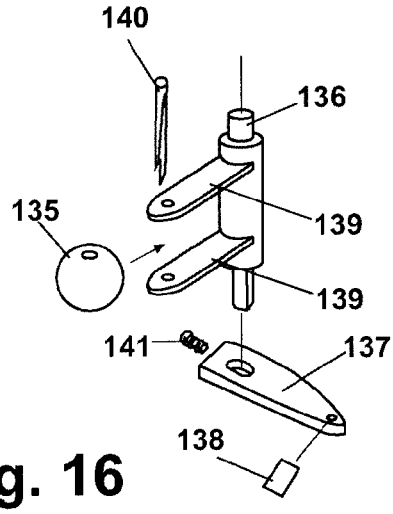
FIG. 16 is a partial exploded view of one embodiment of a valve element for the selector valve shown in FIG. 15.
Figure 15:
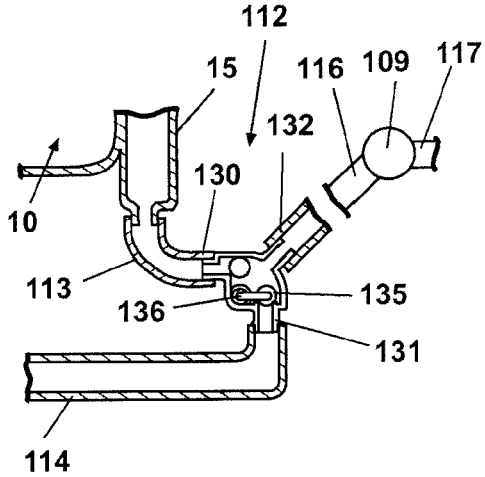
FIG. 15 is a partial sectional view of a dishwasher chamber and filter according to the invention showing connection of the filter chamber to a selector valve, the wash chamber drain and drain pump.

Turning to FIG. 15 and FIG. 16, one embodiment of a selector valve can be seen. Selector valve 112 can have a first inlet 130 that can be connected by line 113 to the filter chamber outlet of filter 15. Selector valve 112 can have a second inlet 131 that can be connected to line 114 that can be connected to wash chamber drain 115, not shown. Selector valve 112 can have an outlet 132 that can be connected to drain pump 109 by line 116. Selector valve 112 can have a valve ball 135 pivotally mounted on pivot 136 to selective close first inlet 130 or second inlet 131. Pivot 136 can have an actuator lever 137 that can be affixed to pivot 136 by fastener 141. Actuator lever 137 can be operated by a valve actuator 138. Valve ball 135 can be mounted to pivot 136 by arms 139 and held in place by pin 140. In operation, to purge filter 15, controller 200 (FIG. 14) can cause actuator 138 to cause valve ball 135 to open inlet 130 and close inlet 131 while operating drain pump 109 to drain wash liquid and food particles from filter 15. To drain wash chamber 10, controller 200 can cause valve actuator 138 to cause valve ball 135 to open inlet 131 and close inlet 130 while operating drain pump 109 to drain wash liquid from wash chamber 10. While a selector valve with a single valve ball is described in the embodiment of FIG. 15 and FIG. 16, those skilled in the art with appreciate that a selector valve with two or more valve elements and two or more actuators can be used.

Figure 17:
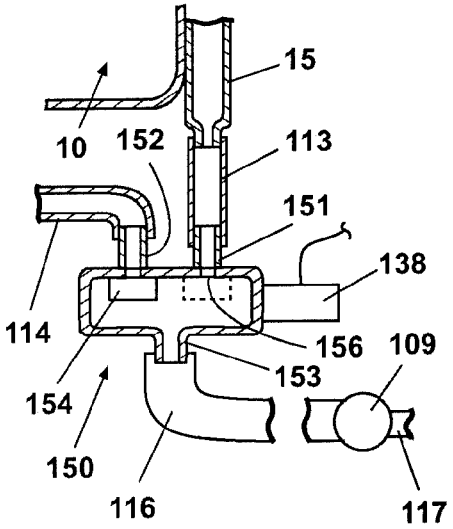
FIG. 17 is a partial sectional view of a dishwasher chamber and filter according to the invention showing connection of the filter chamber to another embodiment of a selector valve the wash chamber drain and drain pump

Turning to FIG. 17, another embodiment of the selector valve can be seen. Selector valve 150 can include a first inlet 151 that can be connected to line 113 leading to filter 15. Selector valve 150 can include a second inlet 152 that can be connected to line 114 that can lead to wash chamber drain 115, not shown. Selector valve 150 can include an outlet 153 that can be connected to line 116 that can lead to drain pump 109. Selector valve 150 can have a slidable valve member 154 to selectively close first inlet 151 or second inlet 152. A valve actuator 138 can be provided to position valve member 154 to selectively close the first or second inlets. Valve actuator 138 can be connected by an actuator link 156 that can be a mechanical or electromagnetic link as is well known in the art. Valve actuator 138 can be a solenoid, a pressure actuated diaphragm or a wax motor. Those skilled in the art will understand that other actuator mechanisms can be used as well. In operation, to purge filter 15, controller 200 can cause valve actuator 138 to position valve member 154 to open first inlet 151 and close second inlet 152 and operate drain pump 109 to pump wash liquid and food particles from filter 15 to drain line 117 for transfer to the household drain, not shown. To drain wash chamber 10, controller 200 can cause valve actuator 138 to position valve member 154 to close first inlet 151, open second inlet 152 and operate drain pump 109 to pump wash liquid from wash chamber drain 114 to drain line 117. While valve member 154 has been shown as a sliding valve element, those skilled in the art will appreciate that selector valve 150 can have any other configuration that permits first and second inlet openings to be selectively opened using one or more that one valve members and one or more valve actuators.

Figure 19:
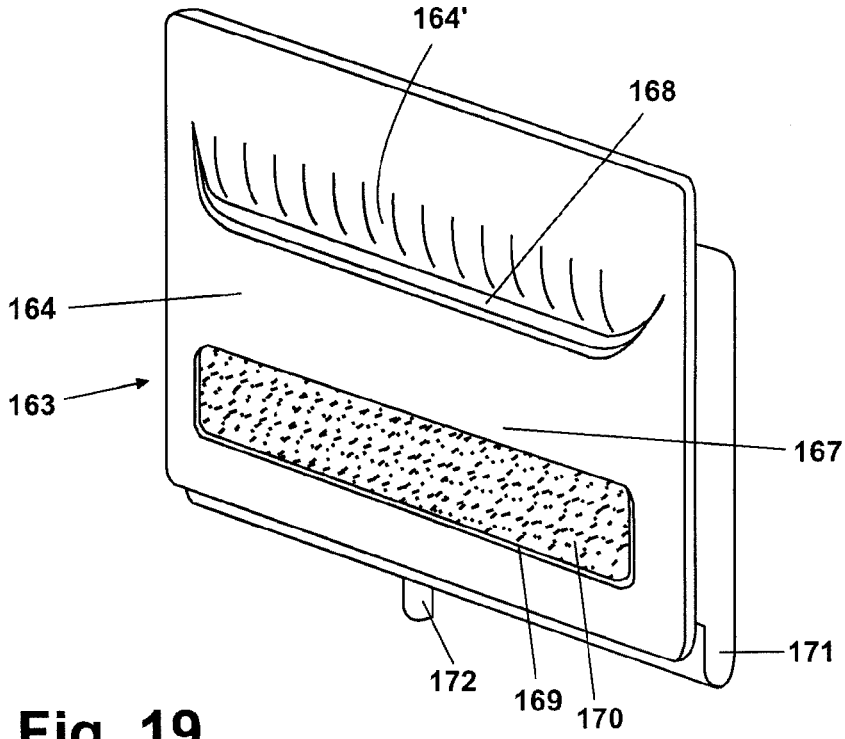
FIG. 19 is a perspective view of the filter of FIG. 18.

Turning to FIG. 18 and FIG. 19, another embodiment of a filter according to the invention can be seen. Wash chamber 160 can have a floor 161 and a wall 162. Wall 162 can have an opening 159 adjacent floor 161. A filter 163 can overlie and close opening 159 in wall 162. Wash chamber 160 can be part of a modular dishwasher as shown in FIG. 1 or can be part of a front loading dishwasher 28 as shown in FIG. 2. Wall 162 can be a side wall, front wall or rear wall of the wash chamber of a modular dishwasher as shown in FIG. 1. In the event the wash chamber is part of a front loading dishwasher 28, as shown in FIG. 2, wall 162 can be a side wall or rear wall of the tub 29. Wall 162 can be the door of a front loading dishwasher as shown in FIG. 2. If desired, wall 162 can have one or more downwardly directed liquid gathering surfaces 162' to direct wash liquid flowing down wall 162 outside the width of inlet opening 168 to flow into inlet opening 168 as in the embodiments shown in FIG. 3, FIG. 4 and FIG. 5.

Filter 163 can have a wall 164 that faces toward wash chamber 160. Wall 164 can have a seal 165 about the periphery of wall 164 to seal filter 163 to wall 162 closing opening 159. Seal 165 can take the form of a resilient gasket, or can be interlocking wall members that present a serpentine path to any wash liquid sprayed against wall 162 sufficient to prevent leakage of any wash liquid as will be readily understood by those skilled in the art. The upper portion 164' of wall 164 can curve inwardly into filter chamber 166. Portion 167 of wall 164 below curving wall portion 164' and curving wall portion 164' can define inlet opening 168 leading from wash chamber 160 to filter chamber 166. Wash liquid flowing down wall 164 and 164' can flow into filter chamber 166 and drop off the bottom end of curving wall portion 164' due to surface tension of the wash liquid on wall portion 164' as described above. Wall portion 167 can have an outlet opening 169 leading from filter chamber 166 to wash chamber 160. A filter element 170 can overlie outlet opening 169 to filter food particles and the like from wash liquid flowing from filter chamber 166 to wash chamber 160. Chamber wall 173 can form filter chamber 166 with wall 164. Filter chamber 166 can include a filter sump 171 that can have a drain outlet 172 for draining wash liquid and accumulated food particles and the like from filter chamber 166. Filter element 170 can be mounted inside filter chamber 166 as shown in FIG. 18 or can be mounted in or on the outside surface of outlet opening 169 with suitable fasteners. Filter chamber 163 can be formed by molding chamber 163 in one piece or assembling filter chamber 163 of two or more components as will be readily understood by those skilled in the art. Filter 163 can include a baffle similar to baffle 83 as shown in the embodiment of FIG. 7. Filter 163 can likewise be provided with one or more sensors and a liquid spray member as shown in the embodiment of FIG. 8. As is the case with the other embodiments of a filter according to the invention, filter 163 can be connected to drain in any of the embodiments shown in FIG. 9-FIG. 13. Filter 163 can be provided with one or more air gaps in wall 173 as in the embodiment shown in FIG. 6.

While the dishwasher filter according to the invention has been specifically described in connection with certain specific embodiments thereof and applied to a drawer dishwasher and an undercounter dishwasher, it is to be understood that this is by way of illustration and not of limitation, and the scope of the appended claims should be construed as broadly as the prior art will permit.

We claim:

1. A dishwasher comprising:

a wash chamber defined by a floor and a plurality of sidewalls each having an interior surface forming a sidewall of the wash chamber and an exterior surface;

a pump for circulating wash liquid in said wash chamber;

a rotatable spray arm for receiving wash liquid from said pump and spraying said wash liquid in said wash chamber;

a filter chamber provided on the exterior surface of one of the wash chamber sidewalls for filtering wash liquid being circulated in said wash chamber comprising:

a chamber wall and the exterior surface of said one of said sidewalls forming the filter chamber;

an inlet opening in said one of said sidewalls communicating with said filter chamber, wherein said one of said sidewalls has a non-linear portion above said inlet opening for allowing wash liquid being circulated in said wash chamber to enter said filter chamber;

an outlet opening in said one of said sidewalls communicating with said filter chamber for allowing wash liquid in said filter chamber to return to said wash chamber;

a filter element provided substantially in the plane of said one of said sidewalls at said outlet opening for filtering particulate material from said wash liquid as said wash liquid passes through said filter into said wash chamber; and a drain outlet at the bottom of said filter chamber for draining wash liquid and material filtered by said filter to drain, wherein the filtering chamber collects particulate material from said wash liquid.

2. The dishwasher of claim 1 wherein said inlet opening is formed by a first wall portion of said one of said sidewalls above said inlet opening curving into said filter chamber and a second wall portion below said inlet opening generally in the plane of said one of said sidewalls, and said outlet opening is formed in said second wall portion.

3. The dishwasher of claim 2 wherein at least said one of said sidewalls has wash liquid gathering surfaces formed on said at least one of said sidewalls for directing wash liquid flowing down said at least one of said sidewalls into said inlet opening.

4. The dishwasher of claim 2 wherein said filter includes a baffle in said filter chamber depending downwardly from said second wall portion spaced from and overlying said outlet opening and said filter.

5. The dishwasher of claim 1 wherein said filter comprises a permeable element overlying said outlet opening.

6. The dishwasher of claim 5 wherein said permeable element is selected from the group of durable woven or non-woven mesh material, porous sheet material, filter media and photo etched sheet material.

7. The dishwasher of claim 1 wherein said outlet opening is positioned adjacent said floor.

8. The dishwasher of claim 7 wherein said spray arm has at least one nozzle positioned to spray wash liquid on said outlet opening as said spray arm rotates in said wash chamber to backwash said filter.

9. The dishwasher of claim 1 wherein said one of said sidewalls is the rear wall of said wash chamber.

10. The dishwasher of claim 1 further comprising a wash chamber drain located in said floor for collecting wash liquid, and at least one pump for draining wash liquid from said wash chamber drain and for draining wash liquid and material filtered by said filter from said filter chamber.

11. A dishwasher comprising:

a wash chamber having a plurality of walls and a floor;

a pump for circulating wash liquid in said wash chamber;

a rotatable spray arm for receiving wash liquid from said pump and spraying said wash liquid in said wash chamber;

a wash chamber drain located in said floor for collecting wash liquid, and at least one pump for draining wash liquid from said wash chamber drain and for draining wash liquid and material filtered by said filter from said filter chamber;

a filter provided external to the wash chamber for filtering wash liquid being circulated in said wash chamber comprising:

a filter chamber defined by a chamber wall and an exterior surface of one of said walls;

an inlet opening in said one of said walls communicating with said filter chamber, wherein said one of said walls has a non-linear portion for allowing wash liquid being circulated in said wash chamber to enter said filter chamber;

an outlet opening in said one of said walls communicating with said filter chamber for allowing wash liquid in said filter chamber to return to said wash chamber;

a filter element provided in a substantially vertical orientation at said outlet opening for filtering particulate material from said wash liquid as said wash liquid passes through said filter into said wash chamber;

a drain outlet at the bottom of said filter chamber for draining wash liquid and material filtered by said filter to drain;

wherein the filtering chamber collects particulate material from said wash liquid; and the dishwasher further having:

a control, and a selector valve having:

a first inlet connected to said filter drain outlet;

a second inlet connected to said wash chamber drain;

an outlet connected to said pump for draining wash liquid;

one or more valve elements movably mounted in said selector valve for selectively closing said first inlet or said second inlet;

one or more valve actuators for causing said one or more valve elements to selectively close said first inlet or said second inlet; and wherein said control operates said one or more valve actuators to close said first inlet or said second inlet when said at least one pump for draining wash liquid is operating.

12. The dishwasher of claim 10 wherein said at least one pump for draining wash liquid comprises a first drain pump connected to said wash chamber drain, and a second drain pump connected to said filter chamber outlet; and said dishwasher includes a control for selectively operating said first drain pump for draining said wash chamber and for selectively operating said second drain pump for draining said filter chamber.

13. The dishwasher of claim 10 wherein said at least one drain pump for draining wash liquid is driven by a reversible motor and said at least one drain pump drains wash liquid from said filter chamber when said motor rotates said at least one drain pump in a first direction, and said at least one drain pump drains wash liquid from said wash chamber when said motor rotates said at least one drain pump in a second direction, and said filter chamber is connected to said at least one drain pump through a valve for closing the connection of said filter chamber to said at least one drain pump.

14. The dishwasher of claim 13 wherein said pump for circulating wash water is driven by said reversible motor and said pump for circulating wash water circulates wash liquid from said wash chamber drain to said rotatable spray arm when said reversible motor rotates in said first direction.

15. The dishwasher of claim 10 further including a sump screen for filtering wash liquid flowing to said pump for circulating wash liquid.

16. The dishwasher of claim 15 wherein said sump screen includes a strainer for collecting large particles filtered from said wash liquid by said sump screen.

17. The dishwasher of claim 1 wherein said wash chamber is a drawer.

18. The dishwasher of claim 1 wherein said dishwasher is an undercounter dishwasher with a front opening wash chamber.

19. A dishwasher comprising:

a wash chamber defined by a floor and a plurality of sidewalls each having an interior surface forming a sidewall of the wash chamber and an exterior surface;

a circulation pump for circulating wash liquid in said wash chamber;

at least one fill valve for adding wash liquid to said wash chamber;

a rotatable spray arm for receiving wash liquid from said circulation pump and spraying said wash liquid in said wash chamber;

a control for operating said circulation pump and said fill valve in one or more preprogrammed dishwashing cycles;

a filter chamber provided on the exterior surface of one of the wash chamber sidewalls for filtering wash liquid being circulated in said wash chamber comprising:

a chamber wall and an exterior surface of said one of said sidewalls forming the filter chamber;

an inlet opening in said one of said sidewalls communicating with said filter chamber, wherein said one of said sidewalls has a non-linear portion above said inlet opening for allowing wash liquid being circulated in said wash chamber to enter said filter chamber;

an outlet opening in said one of said sidewalls communicating with said filter chamber for allowing wash liquid in said filter chamber to return to said wash chamber;

a filter element provided substantially in the plane of said one of said sidewalls at said outlet opening for filtering particulate material from said wash liquid as said wash liquid passes through said filter into said wash chamber;

a drain outlet at the bottom of said filter chamber for draining wash liquid and material filtered by said filter to drain; and at least one sensor for sensing the liquid level in said filter chamber and connected to said control for draining wash liquid and material filtered by said filter in said filter chamber in response to sensing wash liquid rising to a predetermined level in said filter chamber, wherein the filtering chamber collects particulate material from said wash liquid.

20. The dishwasher of claim 19 further comprising a wash chamber drain located in said floor for collecting wash liquid, and at least one pump for draining wash liquid from said wash chamber drain and for draining wash liquid and material filtered by said filter from said filter chamber.

21. A dishwasher comprising:

a wash chamber having a plurality of walls and a floor;

a circulation pump for circulating wash liquid in said wash chamber;

at least one fill valve for adding wash liquid to said wash chamber;

a rotatable spray arm for receiving wash liquid from said circulation pump and spraying said wash liquid in said wash chamber;

a wash chamber drain located in said floor for collecting wash liquid, and at least one pump for draining wash liquid from said wash chamber drain and for draining wash liquid and material filtered by said filter from said filter chamber;

a control for operating said circulation pump and said fill valve in one or more preprogrammed dishwashing cycles;

a filter provided external to the wash chamber for filtering wash liquid being circulated in said wash chamber comprising:

a filter chamber defined by a chamber wall and an exterior surface of one of said walls;

an inlet opening in said one of said walls communicating with said filter chamber, wherein said one of said walls has a non-linear portion for allowing wash liquid being circulated in said wash chamber to enter said filter chamber; an outlet opening in said one of said walls communicating with said filter chamber for allowing wash liquid in said filter chamber to return to said wash chamber;

a filter element provided in a substantially vertical orientation at said outlet opening for filtering particulate material from said wash liquid as said wash liquid passes through said filter into said wash chamber;

a drain outlet at the bottom of said filter chamber for draining wash liquid and material filtered by said filter to drain;

at least one sensor for sensing the liquid level in said filter chamber and connected to said control for draining wash liquid and material filtered by said filter in said filter chamber in response to sensing wash liquid rising to a predetermined level in said filter chamber;

wherein the filtering chamber collects particulate material from said wash liquid; the dishwasher further having:

a selector valve having:

a first inlet connected to said filter drain outlet;

a second inlet connected to said wash chamber drain;

an outlet connected to said pump for draining wash liquid;

one or more valve elements movably mounted in said selector valve for selectively closing said first inlet or said second inlet; and one or more valve actuators for causing said valve element to selectively close said first inlet or said second inlet, said one or more valve actuators operable by said control in conjunction with said pump for draining wash liquid to drain wash liquid from said filter chamber or from said wash chamber.

22. The dishwasher of claim 20 wherein said at least one pump for draining wash liquid comprises a first drain pump connected to said wash chamber drain and a second drain pump connected to said filter chamber outlet, and said control selectively operates said first drain pump for draining said wash chamber and selectively operates said second drain pump for draining said filter chamber.

23. The dishwasher of claim 19 wherein said at least one sensor comprises a plurality of optical sensors positioned for sensing a plurality of wash liquid levels in said filter chamber.

24. The dishwasher of claim 19 wherein said at least one sensor comprises one or more optical or turbidity sensors positioned for sensing a plurality of wash liquid levels in said filter chamber and for sensing the murkiness of wash liquid in said filter chamber and said control is arranged to initiate a purge cycle to drain wash liquid from said dishwasher and replace wash liquid drained from said dishwasher in response to said one or more optical or turbidity sensors detecting a predetermined murky condition.

25. The dishwasher of claim 19 wherein one of said at least one sensor is a pressure sensor for sensing the wash liquid level in said filter chamber.

26. The dishwasher of claim 25 wherein said rotatable spray arm has one or more nozzles arranged to spray wash liquid on said filter element to backwash said filter element, and at least one pressure sensor is located adjacent said filter element for sensing momentary increases in pressure when said rotatable spray arm passes said filter element and said one or more nozzles spray wash liquid on said filter element, and said control is arranged to detect the absence of momentary pressure increases when said circulation pump is circulating wash liquid and thereby infer a stuck spray arm condition and activate a signal to advise the operator of said dishwasher to check the spray arm.

27. The dishwasher of claim 19 wherein said filter element is a permeable element selected from the group of durable woven or non-woven mesh material, porous sheet material, filter media and photo etched sheet material.

28. The dishwasher of claim 19 wherein said control operates a fill valve to add wash liquid to said wash chamber to replace wash liquid drained from said filter chamber.

29. The dishwasher of claim 19 wherein said filter includes a liquid spray member positioned adjacent said filter, and said liquid spray member is connected to a fill valve for spraying wash liquid on said filter when wash liquid is added to said wash chamber for flushing filtered material off said filter.

30. The dishwasher of claim 29 wherein said liquid spray member is a spray nozzle positioned in said filter chamber.

31. The dishwasher of claim 29 wherein said liquid spray member is a spray nozzle positioned in said wash chamber.

* * * * *